US007277065B2

(12) United States Patent
Wu et al.

(10) Patent No.: US 7,277,065 B2
(45) Date of Patent: Oct. 2, 2007

(54) TUNABLE PHOTONIC BAND GAP STRUCTURES FOR MICROWAVE SIGNALS

(76) Inventors: Jay Hsing Wu, 3600 Parc Avenue, Apartment 218, Montreal, Quebec (CA) H2X 3R2; Chunong Qiu, 3590 Ovide Street, Brossard, Quebec (CA) J4Y 2M2; Cindy Xing Qiu, 6215 Bienville Blvd., Brossard, Quebec (CA) J4Y 2Z6; Ishiang Shih, 7905 Rostand Street, Brossard, Quebec (CA) J4X 2R6

( * ) Notice: Subject to any disclaimer, the term of this patent is extended or adjusted under 35 U.S.C. 154(b) by 952 days.

(21) Appl. No.: 10/652,460

(22) Filed: Sep. 2, 2003

(65) Prior Publication Data

US 2005/0046523 A1 Mar. 3, 2005

(51) Int. Cl.
*H01Q 15/02* (2006.01)

(52) U.S. Cl. ..... 343/909; 343/700 MS; 333/202; 333/204

(58) Field of Classification Search ..... 343/909, 343/754, 700 MS; 333/202, 204, 205
See application file for complete search history.

(56) References Cited

U.S. PATENT DOCUMENTS 6,825,741 B2 * 11/2004 Chappell et al. ..... 333/204
6,879,289 B2 * 4/2005 Hayes ..... 343/700 MS
6,943,650 B2 * 9/2005 Ramprasad et al. ..... 333/202
7,151,507 B1 * 12/2006 Herting ..... 343/909

OTHER PUBLICATIONS

E. Yablonovitch, Phys. Rev. Lett., 58, pp. 2059-2062, 1987.
Yongxi Qian and T. Itoh, 1999 IEEE MTT-S International Microwave Symposium Digest, vol. 4, pp. 13-19, Jun. 1999.
V. Radisic, Y. Qian, and T. Itoh, IEEE, Microwave and Guided Wave Letters, vol. 8, Issue 1, pp. 13-14, Jan. 1998.

(Continued)

*Primary Examiner*—Hoang V. Nguyen

(57) ABSTRACT

Photonic Band Gap (PBG) structures are utilized in microwave components as filters to suppress unwanted signals because they have the ability to produce a bandstop effect at certain frequency range depending on the structural dimensions. The unique property of PBG structures is due to the periodic change of the dielectric permittivity so interferences are created with the traveling electromagnetic waves. Such periodic arrangement could exist either inside of the dielectric substrate or in the ground plane of a microstrip transmission line structure. This invention provides tunable or switchable planar PBG structures, which contains lattice pattern of periodic perforations inside of the ground plane. The tuning or switching of the bandstop characteristics is achieved by depositing a conducting island surrounded by a layer of controllable thin film with variable conductivities. The controllable thin film layer could be photoconductive or temperature sensitive that allows change in its conductivity to occur by means of light illumination or temperature variation. Instead of depositing the controllable thin film with variable conductivity, freestanding thin film such as MEMS structures can also be utilized as the medium between the conducting islands and the ground plane. According to this invention, bandstop characteristics of the planar PBG structure are switched off when the controllable thin film is conductive or the freestanding thin film is in contact with the conducting islands and the ground plane. Meanwhile the bandstop characteristics are switched on when the controllable thin film is resistive or the freestanding thin film is not in contact with the conducting islands. At the end, switching uniplanar-compact PBG (UC-PBG) structures with photoconductive or temperature sensitive material, which is deposited inside of the gaps located in the ground plane, is also described.

15 Claims, 10 Drawing Sheets

OTHER PUBLICATIONS

Fei-Ran Yang, Kuang-Ping Ma, Yongxi Qian and T. Itoh, IEEE, Microwave Theory and Techniques, vol. 47, Issue 8, pp. 1509-1514, Aug. 1999.

J. Wu, I. Shih, S.N. Qui et al, 2nd CanSmart Workshop, Smart Materials pp. 171-179, Oct. 2002.

V. Radisic et al., IEEE, Microwave and Guided Wave Letters, vol. 8, Issue 2, pp. 69-71, Feb. 1998.

T. Kim, C. Seo, IEEE, Microwave and Guided Wave Letters, vol. 10, Issue 1, pp. 13-15, Jan. 2000.

D. Cadman et all, High Frequency Postgraduate Student Colloquium, pp. 110-115, Sep. 2000.

* cited by examiner

Prior Art

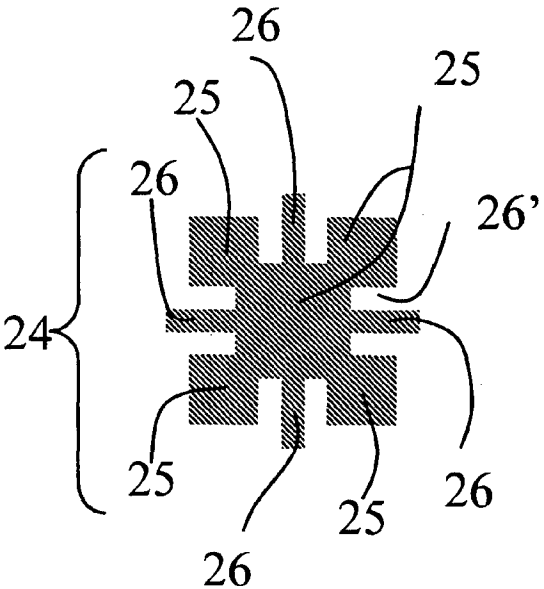
Figure 4
Prior Art
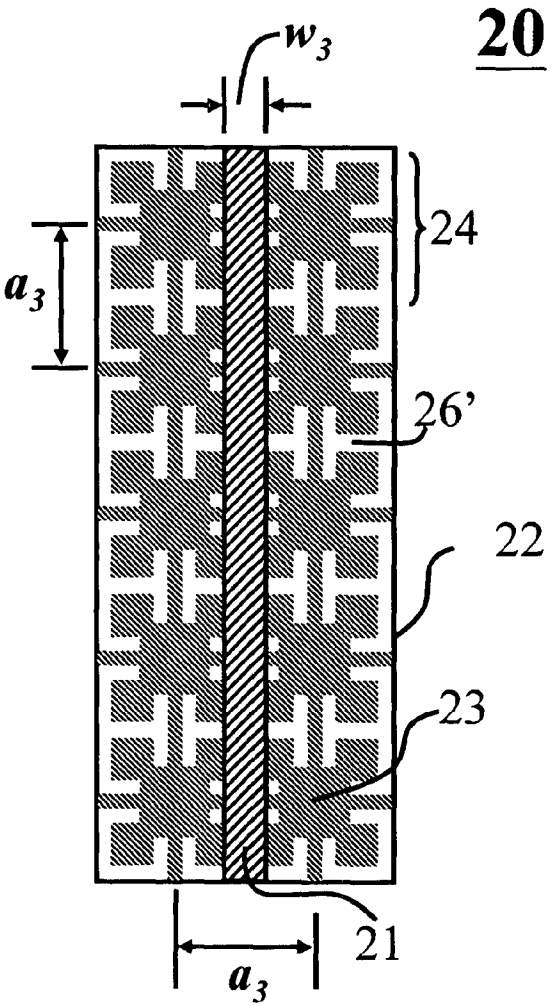

(b)

(a)

TUNABLE PHOTONIC BAND GAP STRUCTURES FOR MICROWAVE SIGNALS

BACKGROUND OF THE INVENTION

1. Field of Invention

This invention relates to a microwave component with a periodic lattice structure to achieve filtering and switching of microwave signals.

2. Brief Description of the Prior Arts

The term "Photonic Band Gap" (PBG) was initially used in optical regime where a strong reflection in a certain range of frequency is observed. Such reflection is caused by periodic changes of dielectric layers with different indices of refraction. Since the propagation of light is prohibited in such a range of frequency, it is referred to as the "band-gap" [E. Yablonovitch, *Phys. Rev. Lett.*, 58, pp. 2059-2062, 1987]. This remarkable property inspires many researchers to put great efforts into the development of PBG structures in microwave and millimeter-wave components [Yongxi Qian and T. Itoh, 1999 IEEE MTT-S International, *Microwave Symposium Digest*, Vol. 4, pp. 13-19, June 1999]. Interests have been paid to microwave PBG structures because of their extraordinary features such as prohibiting electromagnetic waves to travel at frequencies within the PBG. In addition, the PBG structure is an attractive design because it can be integrated with microstrip transmission lines not only to provide better performance, but also to reduce the size and cost of the microwave and millimeter-wave components.

A good PBG design requires a large attenuation in the stop band, controllable bandstop width and controllable central bandstop frequency. Several designs of PBG with different lattice pattern and perforations embedded in either the ground plane or the dielectric substrate of the microstrip transmission line structure have been reported to have bandstop characteristics [V. Radisic, Y. Qian, and T. Itoh, IEEE, *Microwave and Guided Wave Letters*, Vol. 8, Issue 1, pp. 13-14, January 1998] [Fei-Ran Yang, Kuang-Ping Ma, Yongxi Qian and T. Itoh, IEEE, *Microwave Theory and Techniques*, Vol. 47, Issue 8, pp. 1509-1514, August 1999]. A lattice pattern consists of more than one perforations and it may be one-or two-dimensional. For example, a PBG structure 1 shown in FIG. 1 has a one-dimensional one-row lattice pattern, which consists of four rectangular perforations (5, 6, 7, 8) while another PBG structure 14 shown in FIG. 3 has a two-dimensional rectangular lattice pattern 19, which consists of fifteen circular perforations 18. PBG structures for microwave frequencies can be categorized into three groups: dielectric-based PBG, planar PBG, and uniplanar-compact PBG (UC-PBG).

The dielectric-based PBG structures are structures where the lattice pattern, which consists of perforations, is located inside of the dielectric substrate. Therefore, the propagating microwaves traveling in such structures come across periodic change of dielectric permittivity and the bandstop is effectively created. In addition to rectangular lattice pattern, other lattice patterns such as honeycomb and triangular ones with various types of perforations such as circular perforations and square perforations may be adopted in the dielectric-based PBG structures. The attenuation value of the bandstop is proportional to the perforation size (For example, each of the perforations showed in FIG. 1 has a size or area of $d_1 \times l_1$ and the ones in FIG. 3 have a size or area of $\pi r_1^2$). Since the traveling electromagnetic waves are localized around the microstrip transmission line, hence the perforations have to be directly under the line to have effective bandstop characteristics. These dielectric-based PBG structures can be incorporated with power amplifiers for harmonic tuning to increase the power-added efficiency. Moreover, the effect of bandstop can be cascaded serially to create a wide bandstop width. However, the drawback of the dielectric-based PBG structures is that drilling of the dielectric substrate is required to create the perforations.

Planar PBG structures do not require perforation drilling in the dielectric substrate. The lattice pattern is located in the ground plane of the microstrip transmission line where the perforations can be etched easily. A top view of a planar PBG structure 1 is shown in FIG. 1(*a*) and a cross-sectional view of structure 1 along A-A' is also given in FIG. 1(*b*), where on the front surface of a dielectric substrate 2 with a thickness of $h_1$, a microstrip line 3 having a width $w_1$ and a thickness $t_1$ is deposited. A ground plane 4 with a thickness of $t_2$ is deposited at the back surface of the dielectric substrate 2 where four rectangular perforations 5, 6, 7, 8 are etched inside of the ground plane 4 to form a one-row lattice pattern. Each of the perforations 5, 6, 7, 8 has a length $l_1$, a width $d_1$ and a distance between adjacent perforations of $a_1$. It is noted that the microstrip line 3 is located substantially at the center of the perforations 5, 6, 7, 8 (indicated by $d_1/2$ from the edge of the perforations). The purpose of the lattice pattern shown in FIG. 1 is to generate interferences with the traveling electromagnetic waves so that bandstop characteristics can be created.

The characteristics of a microwave component are often given in plots of S-parameters. A typical graph of forward transmission coefficient $S_{21}$ versus frequency for a bandstop filter is given in FIG. 2. Here it is seen that in the low frequency region (less than 10 GHz), the forward transmission coefficient ($S_{21}$) of this filter is about 0 dB. The transmission coefficient decreases as the frequency is increased and reaches a minimum at about 16 GHz. With a further increase in the frequency, the coefficient increases and reaches 0 dB at about 20 GHz. The $S_{21}$ characteristics of the filter in FIG. 2 are thus divided into three regions: a lower bandpass region 9 at frequencies from 0 to 10 GHz, a bandstop region 10 from 10 to 20 GHz and an upper bandpass region 11 from 20 to 25 GHz. Here it is noted that the maximum attenuation 12 is −25 dB whereas the central bandstop frequency 13 of the bandstop region 10 is 15 GHz and the bandstop width is 10 GHz (from 10 to 20 GHz).

It is important to point out that the dimensions of perforations and the arrangement of lattice pattern determine the bandstop characteristics [J. Wu, I. Shih, S. N. Qiu, C. X. Qiu, P. Maltais, D. Gratton, 2$^{nd}$ CanSmart Workshop, *Smart Materials and Structures*, pp. 171 -179, October 2002]. When the number of perforations is increased, the absolute value of maximum attenuation increases. The central bandstop frequency of the PBG structure is related to the period distance ($a_1$, in FIG. 1) as follows:

$$a_1 = \frac{\lambda_g}{2} = \frac{c}{2f\sqrt{\varepsilon_{eff}(f)}}$$

$a_1$=Period distance of the perforations $\lambda_g$=Guided wavelength c=Velocity of propagating wave in free-space f=Propagating frequency $\epsilon_{eff}$(f)=Frequency-dependent effective permittivity It should be mentioned that PBG structures with different lattice pattern and perforations can be constructed. FIG. 3 shows a planer PBG structure 14 built on a dielectric substrate 15 with a microstrip line 16 of width $w_2$ and a ground plane 17. The microstrip line 16 is deposited on the front surface of the dielectric substrate 15 and the ground plane 17 containing the lattice pattern 18 is deposited on the back surface of the dielectric substrate 15. This PBG structure 14 has a rectangular lattice pattern 18, which consists of fifteen (3×5) circular perforations 19, fabricated inside of the ground plane 17 to create a bandstop phenomenon [V. Radisic, Y. Qian, R. Coccioli, and T. Itoh, IEEE, *Microwave and Guided Wave Letters*, Vol. 8, Issue 2, pp. 69-71, February 1998] [Taesun Kim, Chulhun Seo, IEEE, *Microwave and Guided Wave Letters*, Vol. 10, Issue 1, pp. 13-15, January 2000]. The radius of each circular perforation 19 is $r_1$ and the distance between adjacent perforations is $a_2$, which is also called the period distance of the lattice pattern 18. It should be noted that the central bandstop frequency of this planar PBG structure 14 is depended on the period distance ($a_2$) and the size of the perforations 19, given by $r_1$, which is the radius of the circular perforations 19. Therefore, the planar PBG structure 14 can be designed with desired bandstop characteristics and applied in microwave and millimeter-wave components.

A UC-PBG structure is similar to a planar PBG structure because both types of structures have lattice patterns created in the ground plane. However, UC-PBG structures can be made more compact in size without losing the ability to create the bandstop effect. The size of UC-PBG structure can be significantly smaller than the planar PBG structure because of its unique design of the lattice pattern, which consists of metal pads and connecting branches. FIG. 4 shows a typical UC-PBG structure 20 with a microstrip line 21 of a width of $w_3$ deposited on the front surface of a dielectric substrate 22, a lattice pattern implanted inside of the ground plane 23, which is deposited on the back surface of the dielectric substrate 22. The lattice pattern consists of several unit cells 24, which are made of metal pads 25 and metal branches 26. The distance between adjacent unit cells is $\alpha_3$. The metal branches 26 and the gap spaces 26' between each unit cell 24 introduce series inductance and shunt capacitance respectively. Thus, the propagation constant is much larger than the conventional microstrip line structure due to these two additional components. Again, the central bandstop frequency is dependent on the period distance ($\alpha_3$).

For microwave applications, it is advantageous to have PBG structures with tunable microwave characteristics. Some computation work has been reported on a PBG structure assuming optical excitation [D. Cadman, D. Hayes, R. Miles, and R. Kelsall, *High Frequency Postgraduate Student Colloquium*, pp. 110-115, September 2000.]. The PBG structure 27 considered by Cadman et al is shown in FIG. 5, where circular perforations 28 are assumed to be inside of a ground plane 29, which is deposited on the back surface of a photoconductive substrate 30 made of silicon (Si). A microstrip line 31 is deposited on the front surface of the photoconductive Si substrate 30 to have a width $w_4$. The circular perforations 28 have a radius of $r_2$ and a distance between adjacent perforations of $a_4$. The central bandstop frequency is dependent on the period distance ($a_4$) and the attenuation is depended on the radius of circular perforations, $r_2$. As the light is shined on the PBG structure 27 where the perforations 28 are located, electron-hole pairs are generated and the conductivity of the photoconductive Si substrate 30 that is exposed to the light is increased. Thus, an effectively continuous ground plane (without the perforations) is formed and the structure behaves like an ordinary microstrip transmission line (Refers to "bandstop-off" state shown in FIG. 2). Without the illumination, the conductivity of the photoconductive Si substrate 30 is low and the PBG structure 27 produces a bandstop effect (Refers to "bandstop-on" state shown in FIG. 2). There are certain drawbacks in the PBG structure 27. In order to achieve microwave switching, the intensity of light needed is high, which will cause most part of the conductive Si substrate 30 to be conducting. Hence, when the PBG structure 27 is illuminated, the resistance between the transmission line 31 and the ground plane 29 will be substantially decreased, causing un-wanted losses of microwave signals or rendering the PBG structure 27 to be useless. Hence, in addition to the high light intensity requirement, it may not be possible to "switch off" the bandstop effect of the PBG structure 27.

From the above description, it is evident that tunable or switchable PBG structures with low losses, high isolation and low operating power for tuning or switching will be very useful for microwave components and units.

SUMMARY OF THE INVENTION

One objective of this invention is to provide a planar PBG structure with an enhanced lattice pattern to allow switching or tuning of its bandstop characteristics. The enhanced lattice pattern consists of several unit cells inside of a ground plane. Each unit cell is a perforation etched from the ground plane with a smaller conducting island deposited within the perforation. As a result, the conducting island is surrounded with a ring of gap where no ground metal is presented. A controllable thin film layer with variable conductivity is then deposited inside of the ring of gap and overlapping a portion of the ground plane and a portion of the conducting island so changing the conductivity of the controllable thin film layer can control the behavior of the bandstop. The conducting island inside of the perforation is electrically connected to the ground plane when the conductivity of the controllable thin film layer is high. Thus, the bandstop characteristics are eliminated since the ground plane is effectively electrically continuous (Refers to "bandstop-off" state shown in FIG. 2). On the other hand, the conducting island inside of the perforation is electrically isolated from the ground plane when the conductivity of the controllable thin film layer is low. The bandstop characteristics are therefore presented since the ground plane is not electrically continuous (Refers to "bandstop-on" state shown in FIG. 2). The controllable thin film could be a photoconductive material or a temperature sensitive material so that the conductivity can be changed by illumination or temperature variation. Furthermore, by adding the conducting island inside of the perforation, it becomes possible to switch on and off the bandstop characteristics very efficiently (ie, less optical power is required if a photoconductive material is used).

Another objective of the present invention is to provide a method to switch a PBG structure with enhanced lattice pattern. The method involves switching of freestanding thin films such as MEMS structures where four MEMS actuators are deposited at the corners of the conducting island. By controlling the mechanical switch of the MEMS actuators electrically, the bandstop characteristics can be switched.

In addition, a method to switch the UC-PBG structure with the photoconductive or the temperature sensitive material deposited inside of the gap spaces between its unit cells is described.

BRIEF DESCRIPTION OF THE DRAWINGS

FIG. 4 shows a UC-PBG structure 20 with a ground plane consisting of metal pads and branches.

DETAILED DESCRIPTION OF THE PREFERRED EMBODIMENTS

Figure 6:
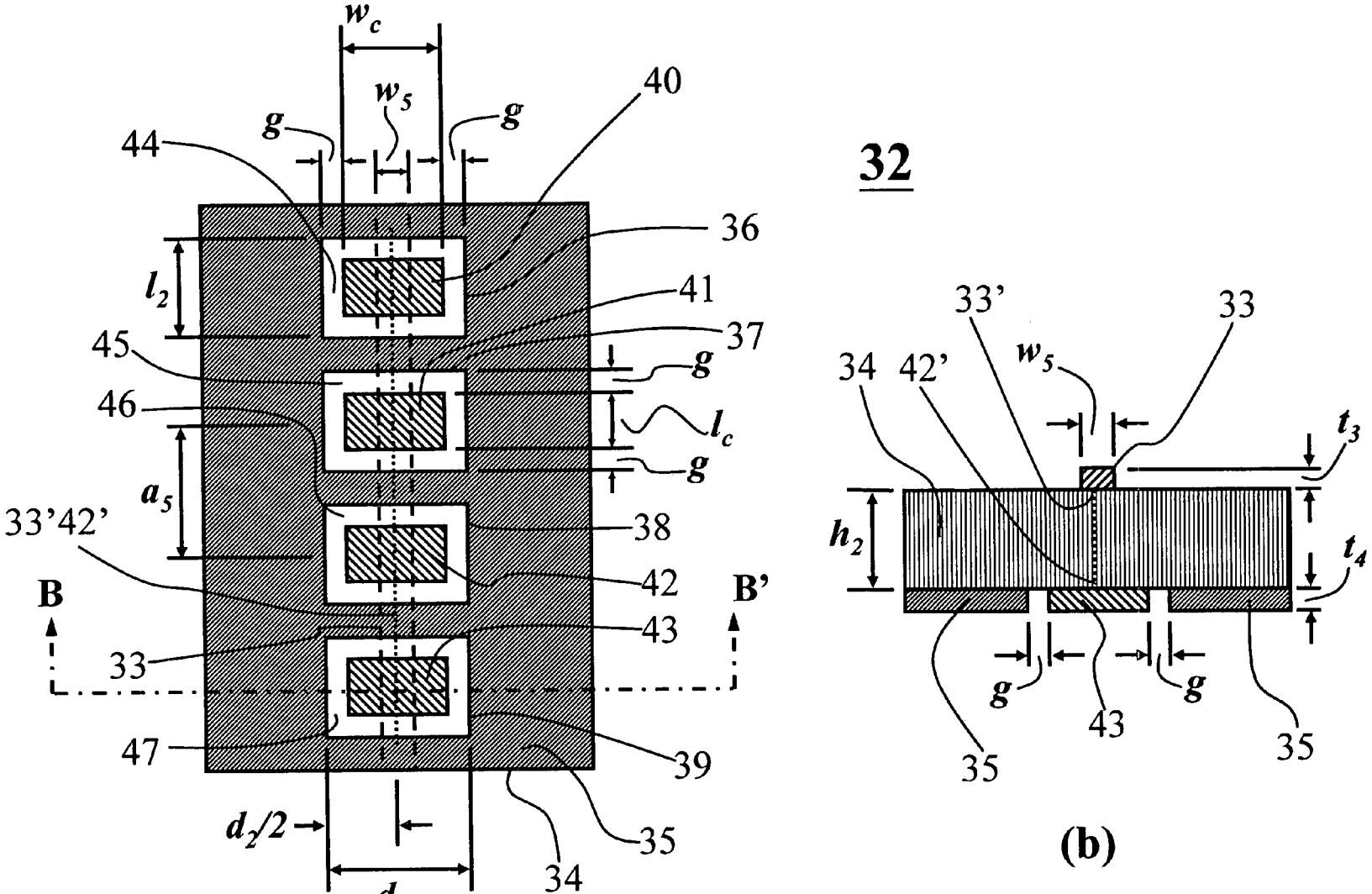
FIGS. 6(*a*) and 6(*b*)show a planar PBG structure 32 of the present invention with conducting islands that are deposited inside of the rectangular perforations.

One objective of this invention is to achieve the switching or tuning of PBG bandstop characteristics so a distinct bandstop is seen ("bandstop-on" state) and such bandstop becomes bandpass when the PBG is switched to a "bandstop-off" state. FIGS. 6(*a*) and 6(*b*) show a top view and a cross-sectional view along B-B' of a PBG structure 32 according to one embodiment of this invention. This PBG structure 32 consists of a microstrip line 33 with a width $w_5$ and a thickness $t_3$ deposited on the front surface of a dielectric substrate 34 of a thickness $h_2$. A ground plane 35 with a thickness of $t_4$ is deposited on the back surface of the dielectric substrate 34. The width $w_5$ of the microstrip line 33 is selected according to the dielectric constant, thickness $h_2$ of the electric substrate 34, and the impedance of the microstrip line required. Inside of the ground plane 35, four rectangular perforations 36, 37, 38, 39 with a length of $l_2$ and a width of $d_2$ are etched to form a one-dimensional one-row (1×4) lattice pattern. It is thus clear that the perforations are defined by the empty regions etched in the ground plane 35. Inside each of the four rectangular perforations (36, 37, 38, and 39), there is a smaller rectangular conducting island (40, 41, 42, 43) deposited on the same surface as the ground plane 35. The rectangular conducting islands 40, 41, 42, 43 have a length $l_c$ and a width $w_c$. Thus, the space between the ground plane 35 and rectangular conducting island 40, 41, 42, 43 within the perforations (36, 37, 38, and 39) defines four hollow rectangular rings of gaps 44, 45, 46, and 47. The distance between adjacent perforations and between adjacent rectangular conducting islands is $a_5$.

To achieve the microwave switching or tuning effectively, it is preferably to deposit the microstrip line 33 so that its axis 33' is along the length ($l_2$) of the perforations (36, 37, 38, and 39). In addition, the axis (or center) 33' of the microstrip line 33 is placed at $d_2/2$ from the edge of the rectangular perforations (36, 37, 38, and 39) so the center 33' of the microstrip line 33 is aligned to the center 42' of the perforations (36, 37, 38, and 39) to generate a maximum bandstop effect. It should be noted that the bandstop effect could still exist even when the center 33' of the microstrip line 33 is not aligned to the center 42' of the perforations (36, 37, 38, and 39). Also, the bandstop maximum attenuation 12 (FIG. 2) is increased as the number of perforations increases. Hence, it is clear that the required microwave characteristics of a PBG structure can be achieved by selecting the dimensions, spacing, and number of perforations and the position of the microstrip line with respect to that of the perforations. Furthermore, more than one row of perforations may be fabricated to enhance the microwave characteristics, although only one row of four perforations (1×4, one dimensional) is shown in FIG. 6 for illustration purpose.

The gap widths between the rectangular conducting islands 40, 41, 42, 43 and the ground plane 35, defining the hollow rings of gaps 44, 45, 46, 47 are given by g, which is selected according to the insertion loss and isolation in the "bandstop-on" state and "bandstop-off" state. Insertion loss is given by the forward transmission coefficient ($S_{21}$) which it is a measure of how much signal is lost during the transmission. Isolation is given by the forward reflection coefficient ($S_{11}$) which it is a measure of how much signal is reflect back to the source. Here, the "bandstop-on" state is the state when the ground plane 35 is substantially isolated electrically from the rectangular conducting islands 40, 41, 42, 43 within the perforations (36, 37, 38, and 39), whereas, the "bandstop-off" state is the state when the ground plane 35 is substantially shorted electrically to the rectangular conducting islands 40, 41, 42, and 43 within the perforations (36, 37, 38, and 39). It is noted that in the "bandstop-on" state, the central bandstop frequency and bandstop width are determined by the dimensions, shape, and distance between adjacent perforations. To increase the central bandstop frequency, the dimensions and the distance between adjacent perforations should be reduced.

Generally, it is desirable to have a low insertion loss in the bandpass region (signals are transmitted) and a high insertion loss in the bandstop region (signals are eliminated in "bandstop-on" state). The characteristic impedance of the microstrip transmission line is depended on the microstrip line width ($w_5$), dielectric substrate thickness ($h_2$), and dielectric substrate material. For example, a typical microstrip transmission line structure used in microwave applications on an alumina ($Al_2O_3$) substrate with dimensions of $w_5=h_2=250$ μm would have a characteristic impedance of 50 Ω. In addition, the conductivities of the microstrip line 33 and the ground plane 35 depend on the material used and their respective thicknesses ($t_3$ and $t_4$). Generally, materials with high conductivity such as gold (Au) and copper (Cu) and adhesion layer materials such as chromium (Cr), titanium (Ti) are desirable to be deposited as the microstrip line 33 and the ground plane 35.

From the above description, it is clear that the distinct feature of the present invention or the enhanced lattice pattern is the introduction of the "conducting islands," which is deposited inside of the perforations in the ground plane. This implementation results in a ring of gap in between the conducting island and the ground plane, in which the conductivity of the region is controlled by a controllable thin film layer. Since the area of the ring of gap is small, the conductivity in this region required to achieve an electrically continuous ground plane can be lower when compared to the case without the conducting island. Therefore, if the controllable thin film layer is a photoconductor, then the optical power required to switch the PBG with the conducting island inside of perforations to a "bandstop-off"

state is much less than that of the PBG without the conducting island inside of the perforations.

Figure 7:
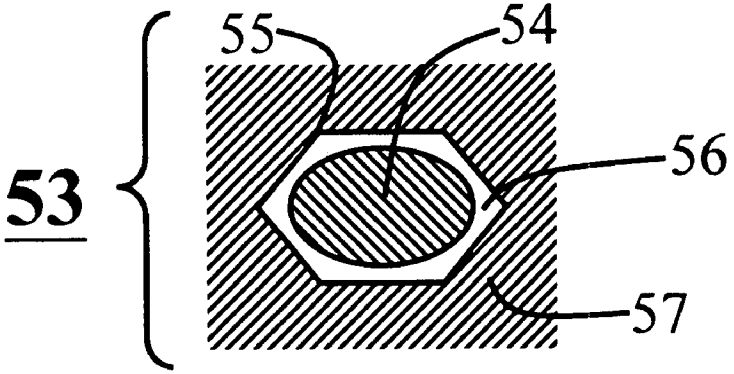
FIG. 7(*a*) shows a rectangular unit cell of the planar PBG structure of present invention and 7(*b*) shows a unit cell with an oval shape of conducting island resides in a hexagon shape of perforation.
Figure 7:
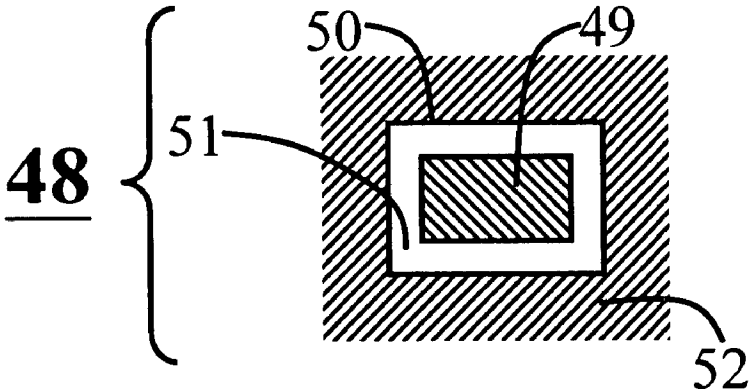

According to another embodiment of this invention, PBG structures with different shapes of unit cells may be adopted for switching and tuning of microwave signals. FIG. 7(*a*) shows one of the unit cell examples, 48, located inside of a planar PBG structure of the present invention, where a rectangular conducting island 49 is deposited inside of a rectangular perforation 50, resulting in a hollow rectangular ring of gap 51 within a ground plane 52. This hollow rectangular ring of gap 51 isolates electrically the conducting island 49 from the ground plane 52 when not connected or actuated. Interferences will take place when microwave signals are propagating through the transmission line (not shown in FIG. 7). When the conducting island 49 is connected electrically to the ground plane 52, the effects of perforations 50 on the propagating microwave signals will be minimized and the interference effects will disappear. It should be noted that the shapes of the perforations and the conducting islands do not necessarily have to be rectangular. They can be square, triangular, hexagonal and even irregular in shape. For instance, FIG. 7(*b*) shows an example of a unit cell 53, where an oval conducting island 54 is deposited inside a hexagonal perforation 55 producing an irregular hollow ring 56 with non-uniform gap between the ground plane 57 and the oval conducting island 54.

Figure 8:
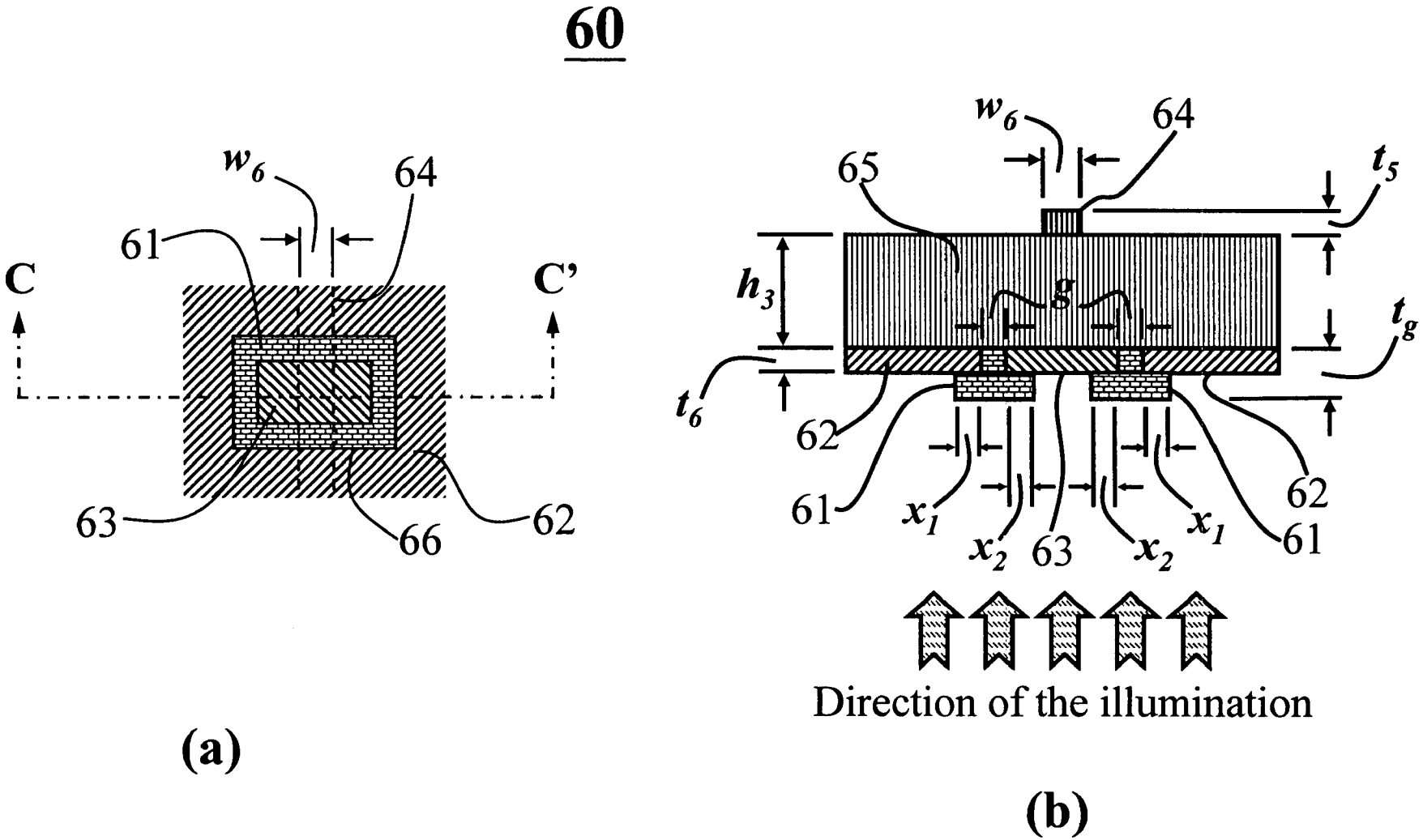
FIG. 8(*a*) shows top view and (*b*) the cross-sectional view along C-C' of a unit cell of a planar PBG structure 60 of present invention with a controllable thin film layer deposited inside of the ring of gap.

According to the present invention, switching or tuning of the bandstop characteristics of a PBG structure 60, as shown in FIG. 8, is achieved by depositing a layer of controllable thin film layer 61 inside of the gap between the ground plane 62 and the rectangular conducting island 63. To simplify the illustration, just a part of the PBG structure 60 with only one perforation is shown in FIG. 8. The PBG structure 60 is fabricated by depositing a microstrip 64 having a width of $w_6$ and a thickness of $t_5$ on the front surface of a dielectric substrate 65 having a thickness of $h_3$. The conducting island 63, with the same thickness $t_6$ as the ground plane 62, is created within the perforation 66, which is etched in the central region of the ground plane 62. A controllable thin film layer 61 (either a photoconductive or a temperature sensitive material) is then deposited within the ring of gap, g, and overlaps at least a portion ($x_1$) of ground plane 62 and at least a portion ($x_2$) of the conducting island 63.

The controllable thin film layer 61 may be photoconductive materials (such as CdS or CdSe), temperature sensitive materials (such as $VO_2$) or electrically sensitive materials, the conductivity of which can be modified by optical, thermal and electrical means. By doing so, the conductivity of the controllable thin film layer 61, deposited inside of the gap and overlapping the ground plane 62 and the conducting island 63, can be changed either by incident light, changing of temperature or applied voltages. When the conductivity of the controllable thin film layer 61 is high, the PBG structure 60 of the present invention shown in FIG. 8 behaves like a normal microstrip transmission line with an electrically continuous ground plane and microwave signals will propagate with minimal interference. Hence, the ground plane 62 will be an effectively continuous one and there will be no bandstop observed in the $S_{21}$ plot (bandstop region 10 of the "bandstop-off" state shown in FIG. 2). When the conductivity of the controllable thin film layer 61 is low, the ground plane 62 loses electrical connection with the conducting island 63 and the propagating microwave signals will experience the periodic perforations 66 in the ground plane 62, causing interferences in the microwave signals (bandstop region 10 of the "bandstop-on" state shown in FIG. 2). By controlling the dimensions and shapes of the perforations and the conducting islands, and by selecting the distance between adjacent perforations (and hence adjacent conducting islands), the bandstop or filter characteristics of the PBG structure of present invention can be conveniently controlled. Hence, when the conductivity of the controllable thin film layer 61 is low the ground plane 62 is not continuous electrically and a bandstop is observed in the $S_{21}$ plot (Refers to "bandstop-on" state shown in FIG. 2).)

According to the present invention, the controllable thin film 61 may be a layer of vanadium oxide ($VO_2$), which is sensitive to temperature changes. When properly deposited and prepared, the conductivity of the $VO_2$ film with a thickness of 0.3 μm can be changed from 1 S/cm to 2500 S/cm when the ambient temperature varies from 340 K to 348 K. When the temperature is reduced below 340 K, the $VO_2$ film will become even more resistive. On the other hand, if the temperature is increased beyond 348 K, the $VO_2$ film will become even more conductive. Both cases improve the performance of the "bandstop-on" and "bandstop-off" states such that high isolation/low insertion loss is observed for the bandpass region (9 and 11 in FIG. 2) and low isolation/high insertion loss is observed for the bandstop region (10 in FIG. 2). Therefore, such a film can be deposited inside of the ring of gaps (44, 45, 46, and 47 in FIG. 6) or even over the entire back surface of the planar PBG structure 32 (FIG. 6) of present invention and the switching of the bandstop effect can be achieved.

Figure 1:
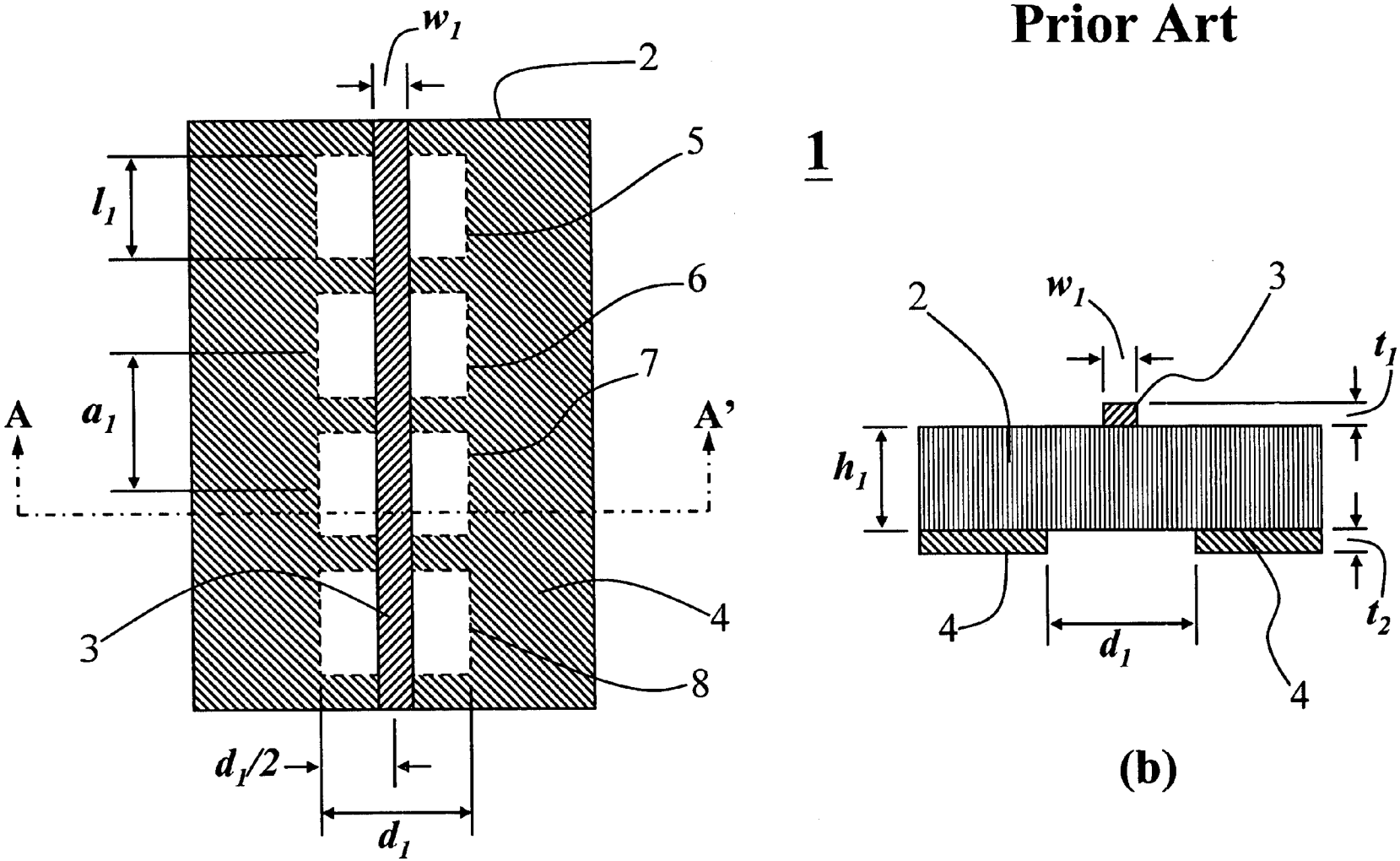
FIGS. 1(*a*) and 1(*b*) show a planar PBG structure 1 with four rectangular perforations to form a one-row lattice pattern (1-D).
Figure 2:
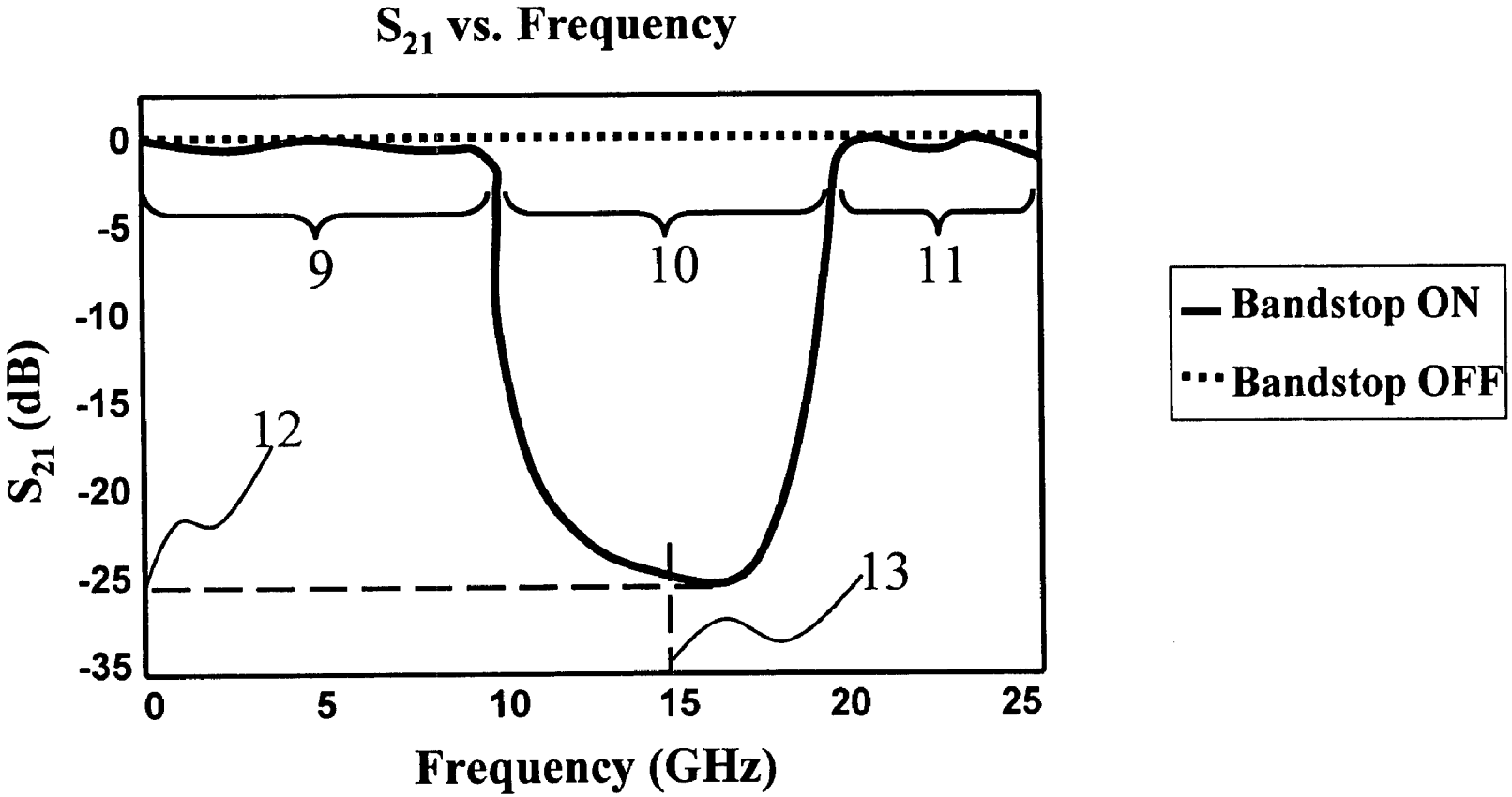
FIG. 2 shows a typical $S_{21}$ plot, which illustrates both "bandstop-on" and "bandstop-off" states.
Figure 3:
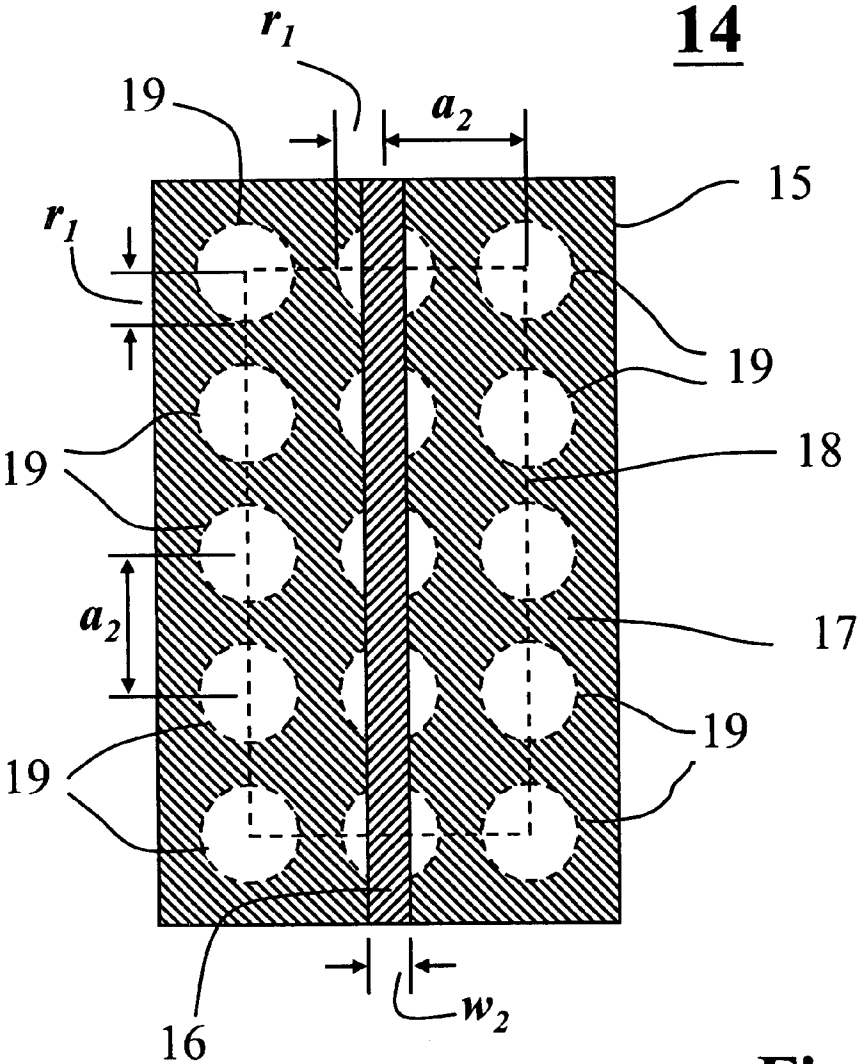
Prior Art Figure 3
FIG. 3 shows a planar PBG structure 14 with a rectangular lattice pattern 18 that consists of fifteen identical circular perforations (2-D).
Figure 5:
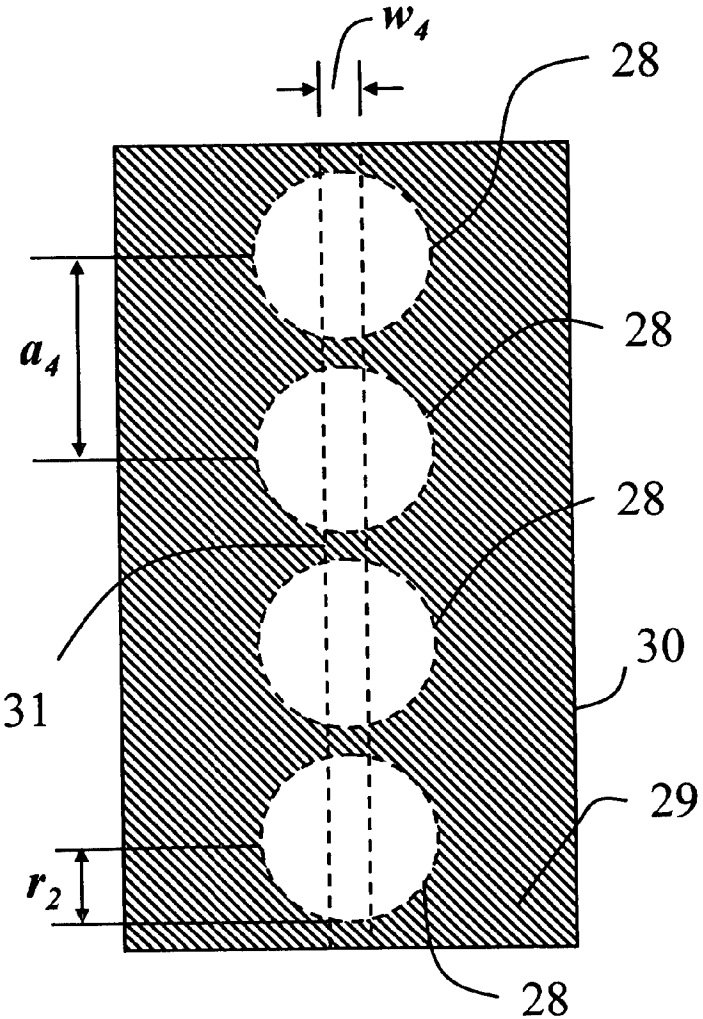
Figure 5 Prior Art
FIG. 5 shows an optically controlled planar PBG structure 27 with silicon as the photoconductive substrate.

The controllable thin film may also be a layer of photoconductor such as CdSe. Under a dark condition, the resistivity of CdSe can be as high as 11400 Ω-cm. Hence, for a controllable CdSe film with a thickness of 1 μm, the sheet resistance will be about $1.14\times10^8$ Ω/square. With such a high resistance, the conducting island is not effectively connected, electrically, to the ground plane and the propagating microwave signals will experience interferences to give rise to bandstop characteristics as shown in FIG. 2, known as the "bandstop-on" state. When a beam of light is incident on the controllable CdSe layer, photons will be absorbed to create electron hole pairs and to cause an increase in the conductivity. For a strong enough incident light such as an UV-illumination from a xenon lamp, the increase in conductivity can be as large as seven orders of magnitude or more. Hence, the sheet resistance of this controllable layer can be reduced to 11.4 Ω/square or less. Under this illumination, the conducting island is electrically connected to the ground plane and the propagating microwave signals will experience minimum interferences. Hence the bandstop will be turned off for this PBG structure.

It is advantageous to deposit the conducting island 63 (FIG. 8) inside of the perforation 66 in the ground plane 62 because the area where the controllable thin film layer 61 needs to be deposited is minimized. Thus, the "bandstop-off" state can be achieved easily without consuming large quantity of optical power, for example, if the photoconductive material is used since only the gap regions (between the conducting island 63 and the ground plane 62) need light excitation.

Figure 9:
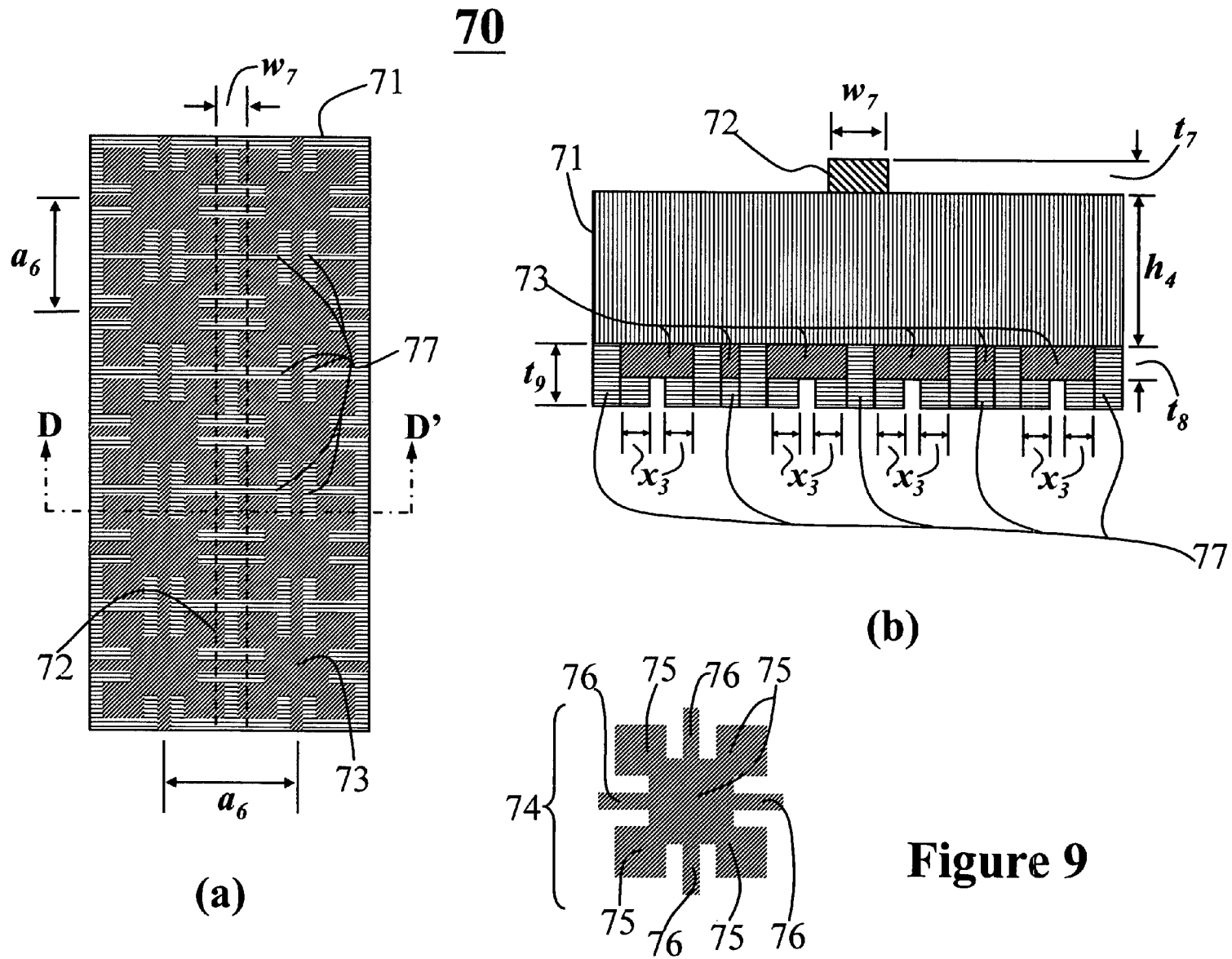
FIGS. 9(*a*) and 9(*b*) show a UC-PBG structure 70 with a controllable thin film layer deposited inside of the gaps, which are located inside of the ground plane.

According to yet another embodiment of the present invention, a controllable thin film layer is deposited on a UC-PBG structure to achieve switching or tuning of microwave signals. FIGS. 9(*a*) and (*b*) show a top view and a cross-sectional view along D-D' of a UC-PBG structure 70. This UC-PBG structure 70 consists of a dielectric substrate 71 with a thickness of $h_4$, a microstrip line 72 with a width $w_7$ and a thickness $t_7$, deposited on the front surface of the dielectric substrate 71, and a ground plane 73 with a thickness of $t_8$. The ground plane 73 consists of 2×5 unit cells 74 of metal pads 75 and branches 76 as the lattice pattern, with a distance between adjacent unit cells of $a_6$. It is noted that the un-filled rectangular regions between each of the unit cells 74 are empty regions etched in the ground plane 73. The controllable thin film layer 77 with variable conductivity is deposited with a thickness of $t_9$ in the gaps, where the metal is etched, and overlaps at least a portion ($x_3$) of the pads 75 and a portion ($x_3$) of branches 76. Thus, when the controllable thin film layer 77 deposited inside of the gaps is in high conductivity state, the ground plane 73 of the UC-PBG structure 70 is continuous electrically and the bandstop effect is eliminated (Refers to "bandstop-off" state shown in FIG. 2). Interferences on the propagating microwave signals are minimal. When the controllable thin film layer 77 deposited inside of the gaps is in low conductivity state, the ground plane 73 of the UC-PBG structure 70 is not continuous electrically and the bandstop effect is presented (Refers to "bandstop-on" state shown in FIG. 2). Interferences in the propagating microwave signals will be present. It is noted that change of conductivity of the controllable thin film layer 77 can be achieved by shining a light beam, by changing the temperature or by applying a voltage.

Figure 10:
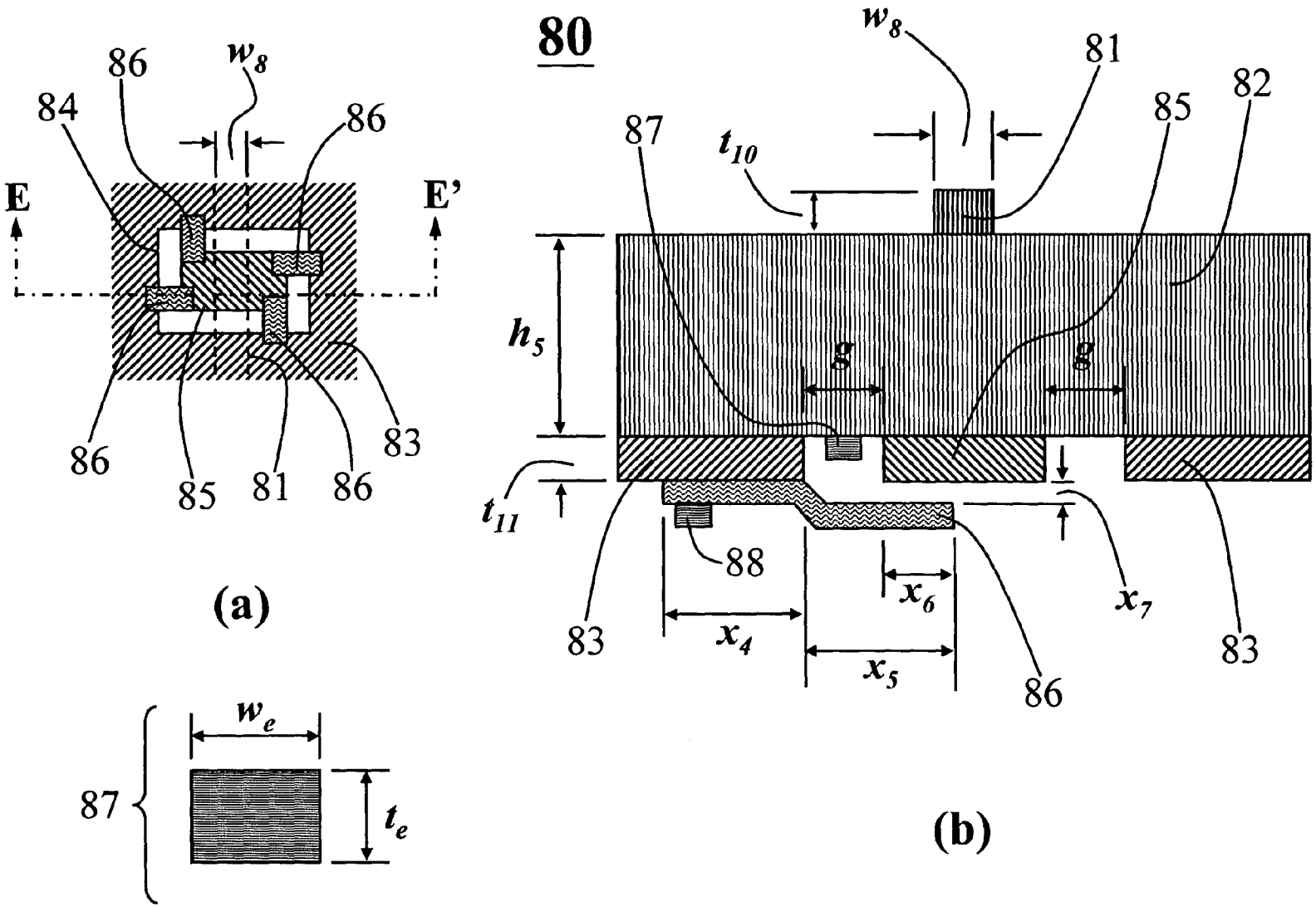
FIGS. 10(*a*) and 10(*b*) show a rectangular unit cell 80 with freestanding thin film structure deposited over four corners of the conducting island.

According to still another embodiment of the present invention, the tuning and switching of PBG structures are achieved by utilizing MEMS structures. FIGS. 10(*a*) and 10(*b*) show a top view and a cross-sectional view along E-E' of a unit cell 80 of a tunable PBG structure. In this structure, a transmission line 81 of a width $w_8$ and a thickness $t_{10}$ is deposited on the front surface of a dielectric substrate 82 with a thickness of $h_5$, while on the back surface of the dielectric substrate 82, a ground plane 83 of a thickness $t_{11}$ is deposited with a rectangular perforation 84 etched. Within the perforation 84, a conducting island 85 with a ring of gap, g, between edges of the conducting island 85 and edges of the ground plane 83 is deposited to define the ring of gap, g. Four freestanding cantilevers 86, each having an anchor region $x_4$ anchored to the ground plane 83, and a suspended region $x_5$ suspending over the gap g and a portion ($x_6$) of the conducting island 85 is fabricated for tuning and switching the unit cell 80 of the tunable PBG structure (Please refer to FIG. 10(*b*), where a cross-sectional view of a unit cell 80 of the tunable PBG with MEMS structures is shown.). The separation between top of the freestanding cantilever 86 and the bottom of the conducting island 85 is defined by $x_7$. Within the gap g and immediately below the suspended portion ($x_5$) of the cantilever 86, a layer of bottom actuating electrode 87 is deposited with a width of $w_e$, a thickness of $t_e$, which is preferably to be substantially less than the thickness $t_{11}$ of the ground plane 83. This bottom actuating electrode 87 is deposited for actuation of the freestanding cantilever 86 by an electrostatic force induced between the freestanding cantilever 86 and the bottom actuating electrode 87. When a dc voltage is applied between the bottom actuating electrode 87 and the ground plane 83, which is connected to the anchored portion ($x_4$) of the freestanding cantilever 86, an electric force will be induced between the freestanding cantilever 86 and the bottom actuating electrode 87. The induced electric force will cause a bending of the freestanding cantilever 86 towards the conducting island 85. By choosing the thickness $t_e$ of the bottom actuating electrode 87 to be less than the thickness $t_{11}$ of the conducting island 85, the freestanding cantilever 86 will make an electrical contact with the conducting island 85.

Hence, by applying an electrical voltage between the ground plane 83 and the bottom actuating electrode 87, the ground plane 83 and conducting island 85 are connected by the four cantilevers 86 and they become an electrically continuous plane, causing minimum interferences to the microwave signals propagating in the PBG structure (refer to "bandstop-off" state shown in FIG. 2). When the dc voltage is removed from between the ground plane 83 and the bottom actuating electrode 87, the cantilevers 86 will recover to the freestanding position and break electrical contact with the conducting island 85. In this situation, interferences will be induced in the propagating microwave signals (refer to the "bandstop-on" state shown in FIG. 2). It is seen in FIG. 10(*a*) that in this unit cell 80, four freestanding cantilever structures 86 are suspended over the four comers of the conducting island 85, which resides in the rectangular perforation 84. In addition, in the case where the freestanding cantilever 86 should be isolated from the ground plane 83, an insulating layer (not shown in the figure) may be deposited between the ground plane 83 and the anchored portion ($x_4$) of the cantilever 86. In such case, a top actuating electrode 88 then is needed to actuate the cantilever 86 and the actuation dc voltage can be conveniently applied via the top and bottom actuating electrodes (88, 87) so that the freestanding cantilevers 86 can be controlled electrically.

The foregoing description is presented for illustration of the key features and spirits of this invention. Therefore, it should not be considered in any ways limitations to the present invention. For example, the number of unit cells, the arrangement, shapes and thicknesses may vary to achieve the same tuning and switching of the propagating microwave signals. The selection of controllable thin film layer may also vary, as long as these materials can respond to optical excitation, thermal excitation or electrical excitation and give a change in their electrical conductivity.

What is claimed is:

1. A structure for filtering and switching of microwave signals comprising:

a substrate with a front surface and a back surface defining a thickness;

a ground plane deposited with a plurality of unit cells on said back surface of said substrate, said unit cells forms a lattice pattern for creation of a microwave bandstop;

a transmission line deposited on said front surface of said substrate, long axis of said transmission line is positioned in parallel to said unit cells and overlaps at least a portion of said unit cells for creation of said microwave bandstop; and a controllable thin film deposited on at least a portion of said ground plane and at least a portion of said unit cell.

2. A structure for filtering and switching of microwave signals as defined in claim 1, wherein each of said unit cells has a perforation inside of said ground plane with a conducting island deposited within said perforation forming a gap between edges of said conducting island and edges of said perforation; isolation and insertion loss of microwave signals through said structure being controlled by width of said gap and by resistivity of said controllable thin film.

3. A structure for filtering and switching of microwave signals as defined in claim 1, wherein said unit cells have a uniplanar compact arrangement inside of said ground plane forming rectangular narrow gaps between adjacent said unit cells; isolation and insertion loss of microwave signals through said structure being controlled by width of said rectangular narrow gaps, by size of said unit cells, and by resistivity of said controllable thin film.

4. A structure for filtering and switching of microwave signals as defined in claim 1, wherein said lattice pattern is one dimensional.

5. A structure for filtering and switching of microwave signals as defined in claim 1, wherein said lattice pattern is two dimensional.

6. A structure for filtering and switching of microwave signals as defined in claim 1, wherein dimensions, shape, number of said unit cells, and distance between adjacent said unit cells are controlled to control central bandstop frequency, bandstop width and attenuation when resistivity of said controllable thin film is large.

7. A structure for filtering and switching of microwave signals as defined in claim 1, wherein said controllable thin film is photoconductive; resistivity of said controllable thin film being controlled by illuminating a light beam.

8. A structure for filtering and switching of microwave signals as defined in claim 1, wherein said controllable thin film is temperature sensitive; resistivity of said controllable thin film being controlled by varying temperature.

9. A structure for filtering and switching of microwave signals comprising:

a substrate with a front surface and a back surface defining a thickness;

a ground plane deposited with a plurality of perforations on said back surface of said substrate, said perforations forms a lattice pattern;

a transmission line deposited on said front surface of said substrate; long axis of said transmission line is positioned in parallel to said perforations and overlaps at least a portion of said perforations for creation of a microwave bandstop;

a plurality of inner conducting islands on said back surface of said substrate, each of said conducting islands being positioned within one of said perforations and forming a gap between edges of said conducting islands and edges of said perforations for creation of said microwave bandstop;

a freestanding thin film layer being anchored onto at least a portion of said ground plane, suspending over at least a portion of said gap and at least a portion of said conducting islands; and a bottom actuating electrode deposited within said gap and overlapping at least a portion of said freestanding thin film layer.

10. A structure for filtering and switching of microwave signals as defined in claim 9, wherein said lattice pattern is one dimensional.

11. A structure for filtering and switching of microwave signals as defined in claim 9, wherein said lattice pattern is two dimensional.

12. A structure for filtering and switching of microwave signals as defined in claim 9, wherein dimensions, shape, number of said perforations, and distance between adjacent said perforations are controlled to control central bandstop frequency, bandstop width and attenuation when said freestanding thin film layer is not in contact with said conducting island.

13. A structure for filtering and switching of microwave signals as defined in claim 9, wherein contact between said freestanding thin film layer and said conducting island is achieved by applying a voltage between said ground plane and said bottom actuating electrode.

14. A structure for filtering and switching of microwave signals as defined in claim 9, wherein isolation of microwave signals is controlled by width of said gap between said ground plane and said conducting island.

15. A structure for filtering and switching of microwave signals as defined in claim 9, wherein insertion loss of microwave signals is controlled by width of said gap and by contact resistance between said freestanding thin film layer and said conducting island.

* * * * *